US010986882B2

(12) United States Patent
Johnson

(10) Patent No.: US 10,986,882 B2
(45) Date of Patent: Apr. 27, 2021

(54) UNIWRAP GARMENT FROM A SINGLE SEAMLESS PIECE OF MATERIAL

(71) Applicant: Barry Charles Johnson, New York, NY (US)

(72) Inventor: Barry Charles Johnson, New York, NY (US)

( * ) Notice: Subject to any disclaimer, the term of this patent is extended or adjusted under 35 U.S.C. 154(b) by 263 days.

(21) Appl. No.: 15/434,286

(22) Filed: Feb. 16, 2017

(65) Prior Publication Data

US 2018/0228231 A1 Aug. 16, 2018

(51) Int. Cl.
*A41D 1/22* (2018.01)

(52) U.S. Cl.
CPC ..... *A41D 1/22* (2013.01); *A41D 2300/324* (2013.01); *A41D 2300/33* (2013.01); *A41D 2400/52* (2013.01)

(58) Field of Classification Search
CPC ... A41D 1/04; A41D 1/18; A41D 1/22; A41D 2300/324; A41D 2300/33; A41D 2400/52; A41D 13/12; A41D 13/1209; A41D 13/1236; A41D 13/1245; A41D 13/1272; A41D 13/129
USPC ..... 2/114, 69, 207
See application file for complete search history.

(56) References Cited

U.S. PATENT DOCUMENTS 1,042,351 A * 10/1912 Johnstone ..... A42B 1/041 2/207
1,071,483 A * 8/1913 Vance ..... A41D 13/02 2/79
1,728,138 A * 9/1929 Robinson ..... A42B 1/041 2/207
2,173,344 A * 9/1939 Spanel ..... A41D 13/04 2/74
2,282,547 A * 5/1942 Spanel ..... A41D 13/04 2/48
2,388,926 A * 11/1945 Mirsky ..... A41D 1/18 2/105
2,462,269 A 2/1949 Krempel
2,520,026 A * 8/1950 Beitchman ..... A41D 10/00 2/227
2,661,472 A * 12/1953 Miller ..... A41D 1/22 2/105
2,680,850 A * 6/1954 Renard ..... A41D 1/22 2/114
2,701,368 A * 2/1955 Swartz ..... A41D 1/00 2/106
2,804,626 A * 9/1957 Rossiter ..... A41D 23/00 2/207
3,080,566 A * 3/1963 Neumann ..... A41D 25/00 2/207
3,154,789 A * 11/1964 Lewis, Jr. ..... A41D 13/1245 128/846

(Continued)

*Primary Examiner* — Alissa L Hoey
(74) *Attorney, Agent, or Firm* — Norton Rose Fulbright US LLP

(57) ABSTRACT

A seamless garment constructed out of a single piece of material will allow for a reduction in manufacturing costs and a lengthened life of the garment due to its simplicity of design and lack of seams. The garment may consist of a single piece of material divided into two panels by a pair of cuts, each extending toward the other, partway through the body of the piece of material. The garment may be secured to the body of a wearer via a variety of attachment mechanisms.

17 Claims, 4 Drawing Sheets

GARMENT 100

(56) References Cited

U.S. PATENT DOCUMENTS 3,339,209 A * 9/1967 Larson ..... A41D 13/1236 128/846
3,522,612 A 8/1970 Palmer
3,557,385 A * 1/1971 Hendrickson ..... A41D 13/1236 2/114
3,777,754 A 12/1973 Plachy
3,781,916 A * 1/1974 Vitol ..... A41D 13/00 2/114
3,835,471 A 9/1974 Lankford
3,911,499 A * 10/1975 Benevento ..... A41D 13/1209 2/114
4,102,155 A * 7/1978 Robinson ..... D04B 1/246 66/176
4,370,755 A 2/1983 Crumby
4,488,544 A 12/1984 Triunfol
4,587,671 A * 5/1986 Rodriguez, Jr. ..... A41D 27/10 2/114
4,608,719 A * 9/1986 Lunt ..... A41D 13/1209 2/114
4,622,699 A 11/1986 Spriggs
4,884,298 A * 12/1989 Silas ..... A41B 13/10 2/49.1
4,920,578 A * 5/1990 Janzen ..... A41D 13/1236 2/114
4,951,318 A * 8/1990 Harreld ..... A41D 13/1209 2/48
4,975,984 A * 12/1990 Sting ..... A41D 13/04 2/105
5,062,159 A * 11/1991 Jakub ..... A41D 13/1236 2/105
5,088,117 A * 2/1992 Fulmer ..... A41D 13/129 2/106
5,097,536 A * 3/1992 Cohen ..... A41D 13/1245 2/106
5,150,477 A * 9/1992 Elberson ..... A41D 13/1236 2/114
5,184,351 A * 2/1993 Benstock ..... A41D 13/1236 2/105
D336,968 S * 7/1993 Russano ..... D2/720
5,274,852 A * 1/1994 Hogan ..... A41D 13/129 2/105
5,454,125 A 10/1995 Ratkowski
5,463,783 A 11/1995 Pope
5,533,653 A 7/1996 Kaufman
5,535,449 A * 7/1996 Dickey ..... A41B 13/06 2/69
5,535,450 A * 7/1996 Melzer ..... A41D 1/06 2/227
5,553,323 A * 9/1996 Chou ..... A41D 13/1245 2/105
5,611,083 A 3/1997 Arnold
5,618,110 A 4/1997 Sullivan
5,664,258 A 9/1997 Harris
5,720,043 A 2/1998 White
5,735,004 A 4/1998 Wooten
5,787,504 A 8/1998 Wu
5,884,331 A 3/1999 Barajas
5,901,375 A 5/1999 Davis
5,946,723 A 9/1999 Rocco
6,029,274 A * 2/2000 Welchel ..... A41D 13/02 2/69
6,154,883 A * 12/2000 Spann ..... A41D 13/1245 2/114
6,243,873 B1 6/2001 Aliff
6,341,379 B1 1/2002 Kokus
D465,317 S 11/2002 Darling
6,675,389 B1 * 1/2004 Kublick ..... B63C 11/04 2/128
6,694,521 B1 * 2/2004 Hopkins ..... A41B 13/08 2/114
6,708,343 B1 3/2004 Ceron
6,760,921 B1 7/2004 Simmons
6,851,127 B1 2/2005 Khan
6,859,942 B1 3/2005 Cratty
7,174,570 B2 2/2007 Dabney
7,222,371 B2 * 5/2007 Houghton ..... A41D 23/00 2/69
7,269,855 B2 9/2007 LaRocco
7,469,424 B2 * 12/2008 Good ..... A41B 13/10 2/48
7,509,689 B2 3/2009 Reardon
7,596,814 B1 * 10/2009 Corby ..... A41D 13/129 2/114
8,566,964 B1 * 10/2013 Acosta ..... A41D 13/1245 2/114
9,357,806 B2 * 6/2016 Terrell ..... A41D 13/129
2002/0152535 A1 * 10/2002 Gaza ..... A41D 13/129 2/114
2004/0010837 A1 * 1/2004 Graves ..... A41D 13/1245 2/114
2006/0037124 A1 * 2/2006 Cho ..... A41D 13/1245 2/114
2006/0272069 A1 12/2006 Sheetz
2006/0277654 A1 * 12/2006 Turner ..... A41D 13/1236 2/114
2006/0277655 A1 * 12/2006 Kerr ..... A41D 13/1236 2/114
2008/0000006 A1 * 1/2008 Ochoa ..... A41D 13/1236 2/114
2008/0066229 A1 3/2008 Auer
2008/0229479 A1 9/2008 Butterly
2009/0055989 A1 3/2009 Chih
2009/0235871 A1 9/2009 Andreas
2010/0050315 A1 * 3/2010 Christou-Kelly ..... A41D 13/1263 2/114
2010/0293697 A1 * 11/2010 McGuyer ..... A41D 13/1245 2/114
2012/0060257 A1 * 3/2012 Herzog ..... A41D 13/1236 2/114
2012/0090072 A1 * 4/2012 Oprandi ..... A41D 13/1245 2/114
2012/0204317 A1 * 8/2012 Bolla ..... A41D 13/1245 2/114
2013/0007942 A1 * 1/2013 Lucas ..... A41D 13/1245 2/114
2013/0067633 A1 * 3/2013 Salem ..... A41D 13/1245 2/102
2013/0091615 A1 * 4/2013 Pasko ..... A41D 13/12 2/114
2013/0133125 A1 * 5/2013 Mungaray ..... A41D 13/1245 2/114
2013/0318682 A1 * 12/2013 Graneto, III ..... A41D 13/1236 2/114
2016/0345645 A1 * 12/2016 Reese ..... A41D 13/1209

* cited by examiner

GARMENT 100

GARMENT 100

GARMENT 100

UNIWRAP GARMENT FROM A SINGLE SEAMLESS PIECE OF MATERIAL

TECHNICAL FIELD

The present invention is concerned generally with articles of clothing composed of a single piece of fabric.

BACKGROUND OF THE INVENTION

Full-body articles of clothing worn in the Western world are typically constructed of multiple pieces of fabric using multiple seams to connect the pieces together. Clothing has become much more complex in construction over time. Modern life continues to demand increased functionality and versatility that adds to the complexity of construction. However, complex construction can result in increased prices for garments and increased time and labor to produce the garments.

BRIEF SUMMARY OF THE INVENTION

A seamless garment constructed out of a single piece of material will allow for a reduction in manufacturing costs and a lengthened life of the garment due to its simplicity of design and lack of seams. The garment may consist of a single piece of material divided into two panels by a pair of cuts, each extending toward the other, partway through the body of the piece of material. The garment may be secured to the body of a wearer via a variety of attachment mechanisms.

According to one embodiment, the garment may consist of a single seamless piece of material, divided into a first front panel and a second back panel by a first cut and a second cut across the body of the piece of material. The first cut and second cut may be located so as to form the second panel into a shoulder covering and the first panel into a torso covering when worn. The piece of material may comprise a variety of man-made or synthetic materials such as paper, plastic, cotton, cashmere, wool, silk, linen, polyester, rayon, nylon, acrylic and rubber. The piece of material may comprise a textile such as a printing, fabrics, velour, a weaving, a knitting, a crocheting, a knotting, or a felting. The second panel may have an opening located to allow a wearer's head to fit through so that the second panel will rest around the neck and on the shoulders of a wearer. The first panel may be seamlessly connected to the second panel by a portion of the single seamless piece of material between the first and second cuts. The garment may have a first strap and a second strap attached to opposite edges of the first panel, located to tie together and wrap the first panel around a body of a wearer. The second panel may also have first and second attachment mechanisms located to connect a first edge of the second panel to a second edge of the second panel located opposite the first edge, so as to create sleeves for a wearer. The first and second attachment mechanisms may comprise buttons, snaps, magnets, hooks and eyes, or ties. The garment may also comprise a gap in the piece of material running from the hole in the center of the second panel to an external edge of the piece of material. The garment may comprise a third attachment mechanism along the gap located to close the gap. The third attachment mechanism may comprise buttons, snaps, magnets, hooks and eyes, or ties.

According to another embodiment, a method for manufacturing a garment may include providing a rectangular piece of material. The piece of material may then be formed into a first panel and a second panel by making a first cut from a first edge of the piece of material towards the center of the piece of material and a second cut from a second edge of the piece of material towards the center of the piece of material, opposite the first cut, leaving a portion of the piece of material connecting the first panel to the second panel in between the two cuts. After the panels are formed, a first strap and a second strap extending from opposite edge of the first panel and running parallel to the first and second cuts may be formed. An opening may be formed in the center of the second panel. Finally, a first attachment mechanism may be fixed to a first corner of the second panel, next to the first cut, located to attach the first corner of the second panel to a second corner of the second panel, and a second attachment mechanism may be fixed to a third corner of the second panel, the third corner being next to the second cut, located to attach the third corner of the second panel to a fourth corner of the second panel.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
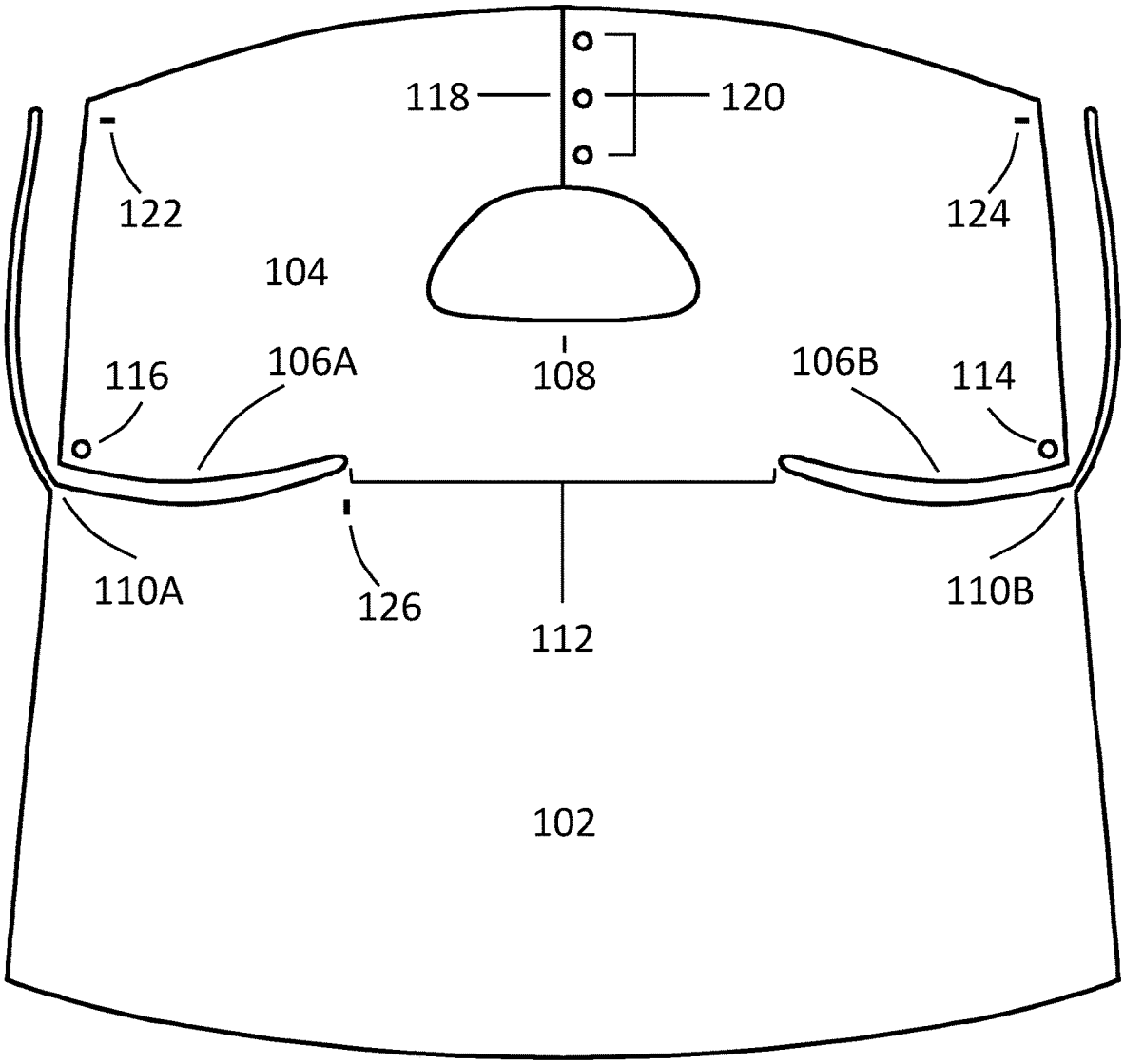
FIG. 1 is an expanded view of the garment.

FIG. 1 is an expanded view of a garment 100, according to some embodiments. The garment may be constructed from a single seamless piece of material. The single seamless piece of material may comprise a first panel 102 and a second panel 104. The second panel 104 may have a first side, a portion 112 of which may be seamlessly connected to a first side of the first panel 102 at a waistline of a wearer. There may be a neck opening 108 in the second panel. The neck opening 108 may be located approximately in the center of the second panel. The neck opening may be further located in a center-front position. In some embodiments the first panel 102 of the piece of material may be separated from the second panel 104 of the piece of material by a first cut 106A and a second cut 106B. The first panel 102 may be seamlessly connected to the second panel 104 by a portion 112 of the single seamless piece of material between the first cut 106A and the second cut 106B. In some embodiments, the piece of material may comprise a disposable cutout. The piece of material may comprise natural and synthetic materials such as cotton, wool, cashmere, silk, or linen and paper, plastic, polyester, rayon, nylon, acrylic, or rubber. The piece of material may comprise a textile such as a printing, fabrics, velour, a weaving, a knitting, a crocheting, a knotting, or a felting.

In some embodiments, the garment may have a first strap 110A, connected to a second edge of the first panel 102 and a second strap 110B connected to a third edge of the first panel 102. The straps may be loose pieces of material that can be tied together to wrap the first panel around the body of a wearer and may be formed from the single seamless piece of material or attached to the piece of material. The straps may be made from the same type of material as the piece of material or a different type of material. The garment may also include a slot 126 for the first and second straps to pass through to the inside of the garment, when worn, so as to keep them from becoming an inconvenience to the wearer. The garment may have alternative or additional attachment mechanisms for the first and second straps 110A and 110B such as a button, a snap, a magnet, or hooks and eyes in place of the first strap 110A and second strap 110B. The garment may have a first attachment mechanism 114 and a second attachment mechanism 116. The first attachment mechanism 114 and second attachment mechanism 116 may be located to connect the first edge of the second panel 104 to a second edge of the second panel 104 so as to create sleeves when worn by a wearer. The attachment mechanisms 114, 116 may be buttons, snaps, magnets, hooks and eyes, ties, or other attachment mechanisms. In embodiments where the first and second attachment mechanisms 114, 116 are buttons, the first attachment mechanism 114 may be located to connect to a first buttonhole 124 and the second attachment mechanism 116 may be located to connect to a second buttonhole 122. The first and second buttonholes 124, 122, may alternatively be corresponding attachment mechanisms in cases where the first and second attachment mechanisms 114, 116 are not buttons.

The garment may have a gap 118 extending from the neck opening 108 to an external edge of the first panel 104. The gap 118 may allow for a wearer to more easily wear the garment with the opening 108 around their neck and the second panel 104 across their shoulders. The gap 118 may be closable by a third attachment mechanism 120 located along the gap 118 and located to close the gap 118 so that the opening 108 will close around the neck of a wearer. The third attachment mechanism 120 may comprise a button, a snap, hooks and eyes, a magnet, a tie, or other attachment mechanism. A plurality of attachment mechanisms 120 may also be used to close the gap 118.

Figure 2:
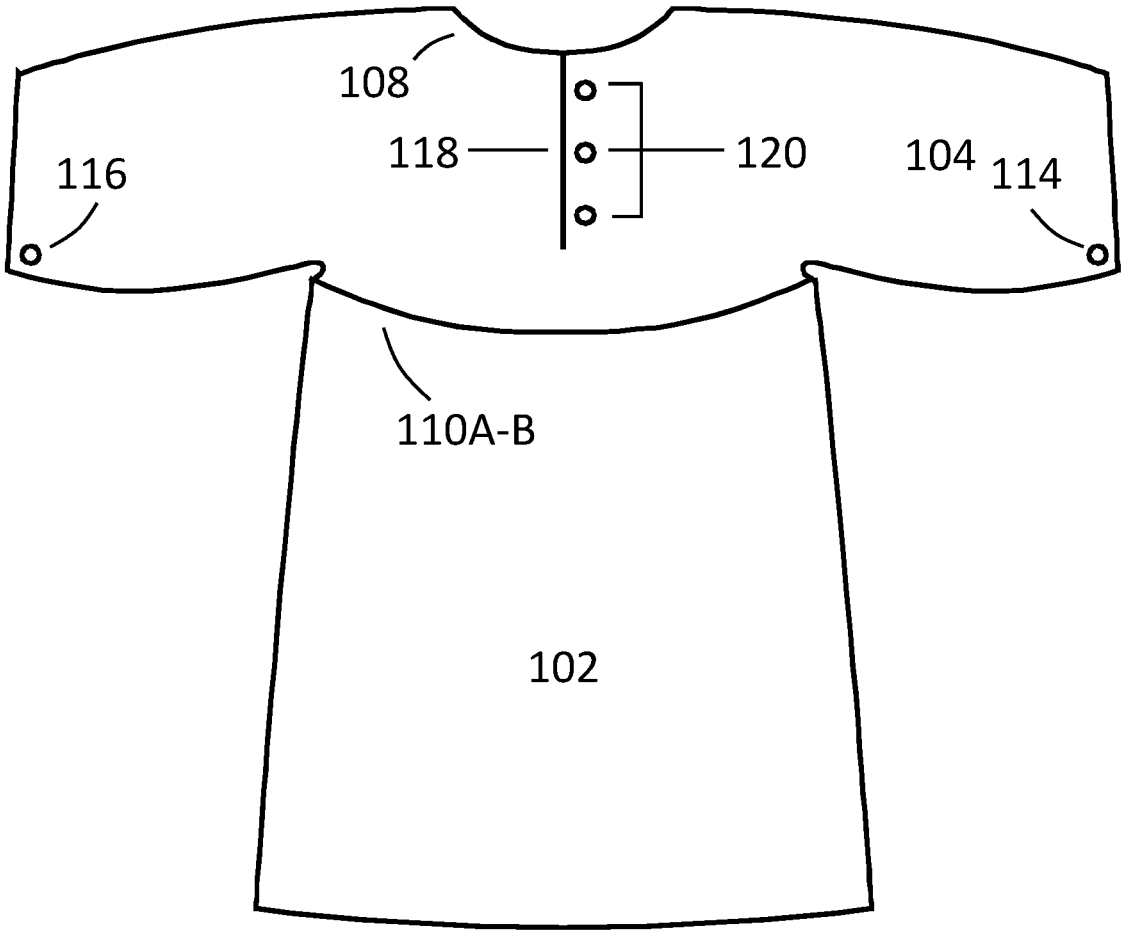
FIG. 2 is a front view of the garment.

FIG. 2 is a front view of the garment as potentially worn by an individual according to some embodiments of the invention. The second panel 104 may rest on the shoulders of the individual and wrap around the individual's arms. The first panel 102 may wrap around the individual's torso and legs. The first strap 110A and second strap 110B may wrap around the torso of the individual and tie together in order to secure the first panel 102 around the individual's torso and legs. In some embodiments a length and a width of the first panel 102 and the second panel 104 may be tailored to the dimensions of the individual or produced in incremental sizes such as small, medium, and large. The garment may also be produced as a one size fits all garment. The length of the first panel 102 may be tailored to reach the individual's knee, thigh, ankle, or foot.

Figure 3:
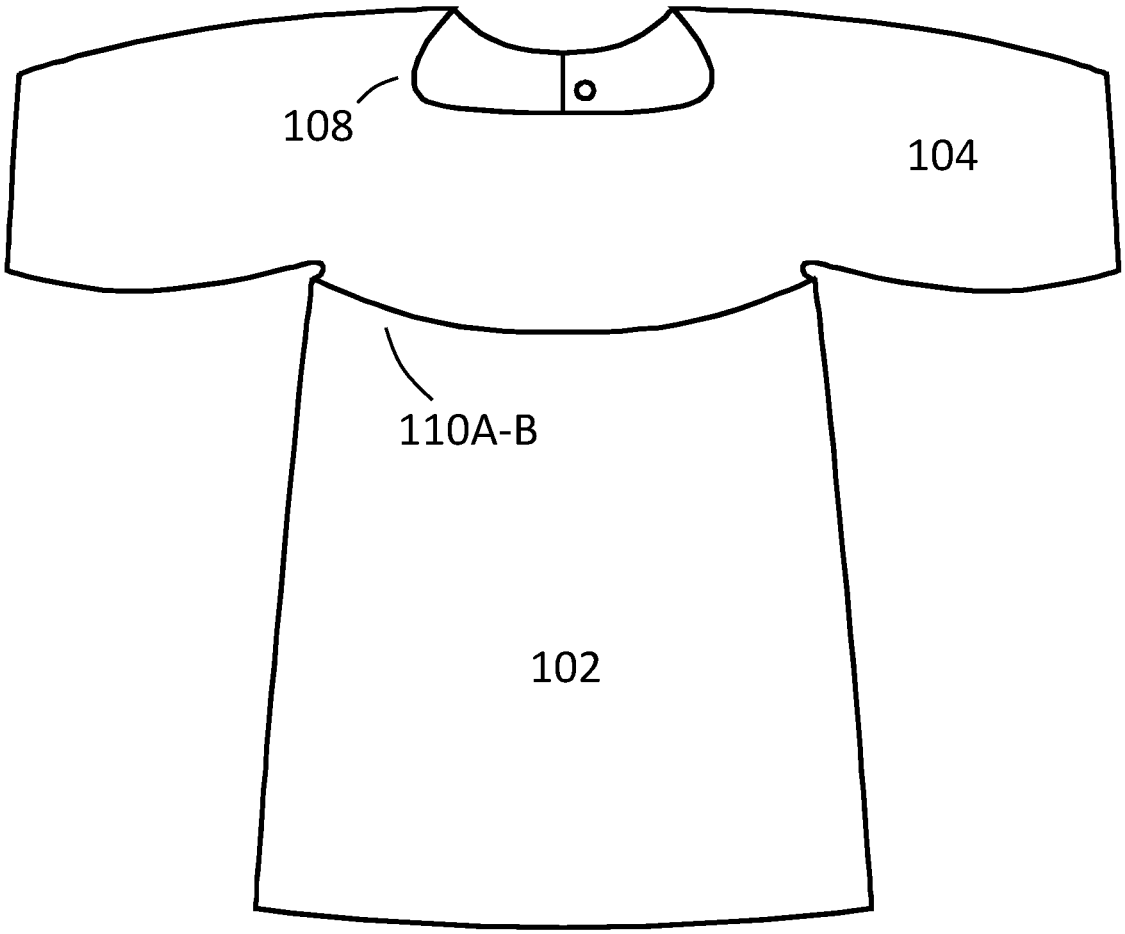
FIG. 3 is a rear view of the garment.

FIG. 3 is a rear view of the garment as potentially worn by an individual according to some embodiments of the invention. In addition to the first panel 102, the second panel 104, and the first strap 110A and second strap 110B discussed with respect to FIG. 2, the hole 108 is shown, which may be located around the individual's neck.

Figure 4:
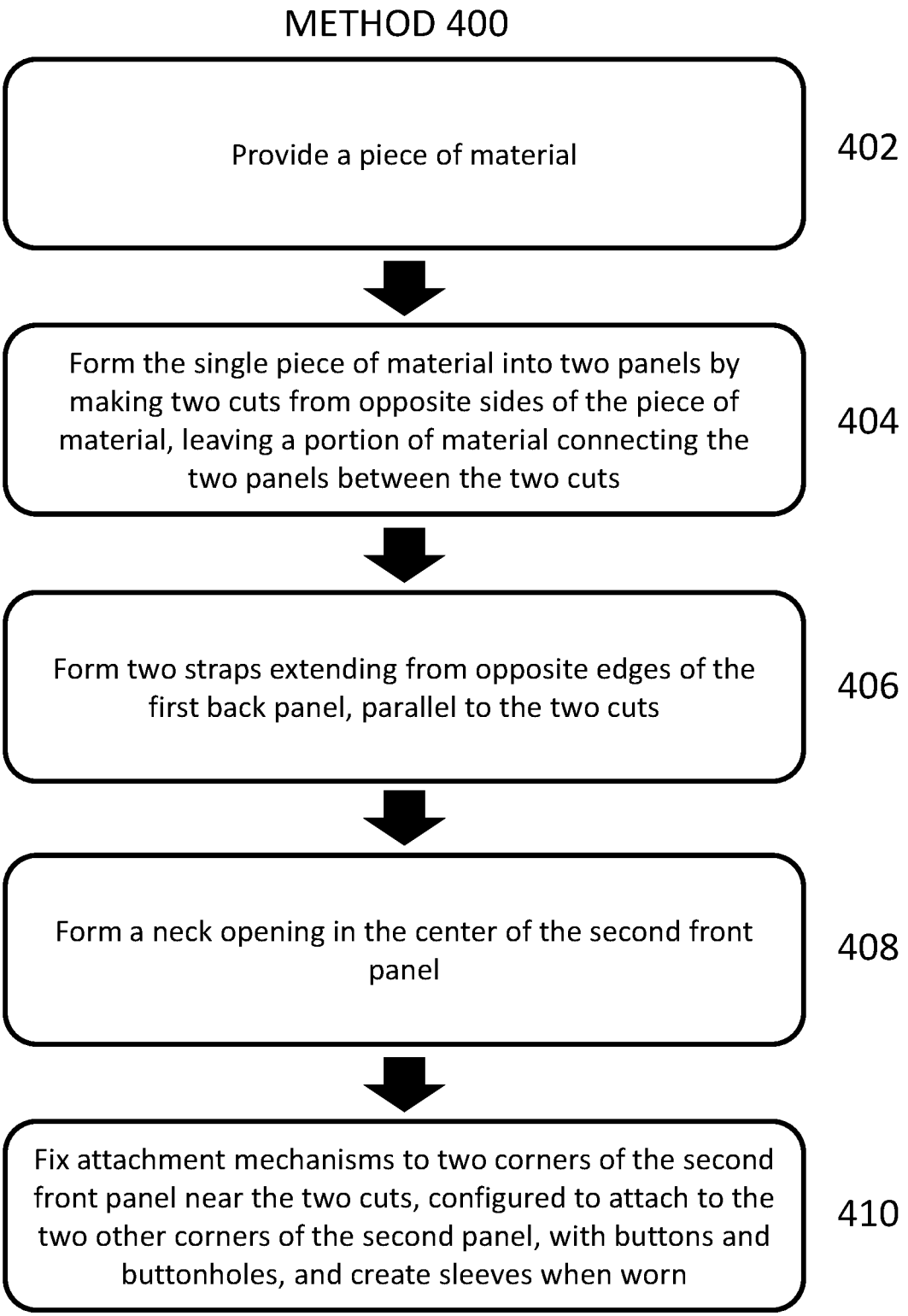
FIG. 4 is a flow chart illustrating an example method for manufacturing a single-piece garment.

FIG. 4 is a flow chart illustrating a method of manufacture according to some embodiments of the invention. A method 400 may begin at block 402 with provision of a piece of material. The method 400 may proceed to block 404 where the piece of material may be formed into two panels (e.g., first panel 102 and second panel 104). This may be accomplished by making a first cut from a first edge of the piece of material towards the center of the piece of material and a second cut from a second edge of the piece of material towards the center of the piece of material opposite the first cut and located approximately along a latitudinal line from the first cut, leaving a portion (e.g., portion 112) of the piece of material connecting the first panel to the second panel. The cuts may divide the first panel from the second panel (e.g. first and second cuts 106 A-B). At block 406, the method 400 includes forming a first strap and a second strap (e.g. first and second straps 110 A-B) extending from opposite edges of the first panel running parallel to the first and second cuts. Then, at block 408, an opening (e.g., opening 108) is formed in the center of the second panel. The method 400 then continues at block 410 with fixing two attachment mechanisms (e.g. first attachment mechanism 114 and second attachment mechanism 116) to two corners of the second panel near the two cuts. The two attachment mechanisms may be located to attach to two corners on the opposite edge of the second panel and create sleeves when the garment is worn. Fixing two attachment mechanisms to the two corners of the second panel may include attaching buttons and forming corresponding buttonholes.

The schematic flow chart diagram of FIG. 4 is generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

Moreover, the scope of the present application is not intended to be limited to the particular embodiments of the process, machine, manufacture, composition of matter, means, methods and steps described in the specification.

What is claimed is:

1. A garment, comprising:

a single seamless piece of material comprising:

a first panel;

a second panel divided from the first panel by a first cut and a second cut; and an opening in the second panel;

a first attachment mechanism coupled to a first corner of the second panel;

a second attachment mechanism coupled to a second corner of the second panel;

a first strap, extending from a second edge of the first panel; and a second strap, extending from a third edge of the first panel, located opposite the second edge of the first panel, wherein the first and second attachment mechanisms are located to connect a first edge of the second panel to a second edge of the second panel, located opposite the first edge of the second panel, so as to create seamless sleeves for a wearer, wherein the first strap and the second strap are located to tie together and wrap the first panel around a body of a wearer, wherein the first strap and the second strap are formed from the single seamless piece of material, wherein, the first cut and the second cut are located so as to form the second panel into a shoulder covering and the first panel into a torso covering when worn, and wherein the single seamless piece of material further comprises a slot in the first panel for allowing the first strap and the second strap to pass through to an inside of the garment when the garment is worn, wherein the slot is located beneath and vertically aligned with a point at which the first cut meets a portion of the single seamless piece of material joining the first panel to the second panel.

2. The garment of claim 1, wherein a first edge of the first panel is seamlessly connected to the first edge of the second panel between the first cut and the second cut by the portion of the single seamless piece of material joining the first panel to the second panel.

3. The garment of claim 1, wherein the piece of material is disposable.

4. The garment of claim 1, wherein the piece of material comprises a synthetic material.

5. The garment of claim 1, wherein the piece of material comprises a natural material.

6. The garment of claim 1, wherein the piece of material comprises a textile.

7. The garment of claim 6, wherein the textile comprises a printing.

8. The garment of claim 6, wherein the textile comprises a fabric.

9. The garment of claim 1, wherein the first and second attachment mechanisms comprise buttons.

10. The garment of claim 1, wherein the first and second attachment mechanisms comprise ties.

11. The garment of claim 1, wherein the first and second attachment mechanisms comprise snaps.

12. The garment of claim 1, further comprising a gap in the second panel running from the opening in the second panel, to an external edge of the piece of material.

13. The garment of claim 12, further comprising a third attachment mechanism along the gap located to close the gap.

14. The garment of claim 13, wherein the third attachment mechanism comprises a button.

15. The garment of claim 13, wherein the third attachment mechanism comprises a snap.

16. The garment of claim 13, wherein the third attachment mechanism comprises a tie.

17. The garment of claim 1, wherein the first strap extends from a first corner of the first panel adjacent to the first cut and wherein the second strap extends from a second corner of the first panel adjacent to the second cut.

* * * * *